US007750510B2

(12) United States Patent
Richtsmeier et al.

(10) Patent No.: US 7,750,510 B2
(45) Date of Patent: Jul. 6, 2010

(54) DEVICE SWITCH ACTUATION

(75) Inventors: Dean Richtsmeier, Boise, ID (US); Howard Hooper, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1493 days.

(21) Appl. No.: 10/772,889

(22) Filed: Feb. 4, 2004

(65) Prior Publication Data

US 2005/0168903 A1 Aug. 4, 2005

(51) Int. Cl.
*H01H 9/00* (2006.01)
*H01H 13/14* (2006.01)

(52) U.S. Cl. ..... 307/119; 200/309; 200/552

(58) Field of Classification Search ..... 200/552, 200/308–310, 314, 315, 329, 553; 399/3, 399/32–39, 81; 307/119
See application file for complete search history.

(56) References Cited

U.S. PATENT DOCUMENTS

| | | | | |
|---|---|---|---|---|
| 1,568,508 | A | 1/1926 | Johnson | |
| 3,737,604 | A | 6/1973 | Dietrich et al. | |
| 3,967,086 | A | 6/1976 | Bauer | |
| 4,024,367 | A * | 5/1977 | Kodaira et al. | 200/308 |
| 4,191,867 | A * | 3/1980 | Feaster | 200/16 R |
| 4,760,227 | A * | 7/1988 | Boxer | 200/330 |
| 4,821,070 | A * | 4/1989 | Nakade et al. | 399/81 |
| 4,890,401 | A * | 1/1990 | Weisfeld | 38/43 |
| 5,558,211 | A * | 9/1996 | Heydner et al. | 200/553 |
| 5,610,379 | A * | 3/1997 | Muz et al. | 200/552 |
| 5,810,109 | A * | 9/1998 | Chu | 200/308 |
| 5,877,746 | A * | 3/1999 | Parks et al. | 345/156 |
| 6,075,925 | A * | 6/2000 | Downing et al. | 358/1.1 |
| 6,337,961 | B2 * | 1/2002 | Mori et al. | 399/82 |
| 6,459,060 | B1 * | 10/2002 | Bartok | 200/553 |
| 6,576,855 | B2 * | 6/2003 | Levendis et al. | 200/339 |
| 6,590,175 | B1 * | 7/2003 | Lam | 200/315 |
| 6,774,509 | B2 * | 8/2004 | Chu | 307/112 |
| 6,794,592 | B1 * | 9/2004 | Liu et al. | 200/302.3 |

FOREIGN PATENT DOCUMENTS

JP 59050381 A * 3/1984

* cited by examiner

*Primary Examiner*—Albert W Paladini
*Assistant Examiner*—Hal I Kaplan

(57) ABSTRACT

An electronic device includes a substantially planar face, a switch and a switch actuation mechanism. The switch is configured such that successive actuations of the switch actuates the device between a first state and a second state. The switch actuation mechanism is configured to actuate the switch a first time in response to a first input along the face and a second time in response to a second input along the face. The second input has at least one characteristic, other than time at which it is performed, distinct from the first input.

36 Claims, 7 Drawing Sheets

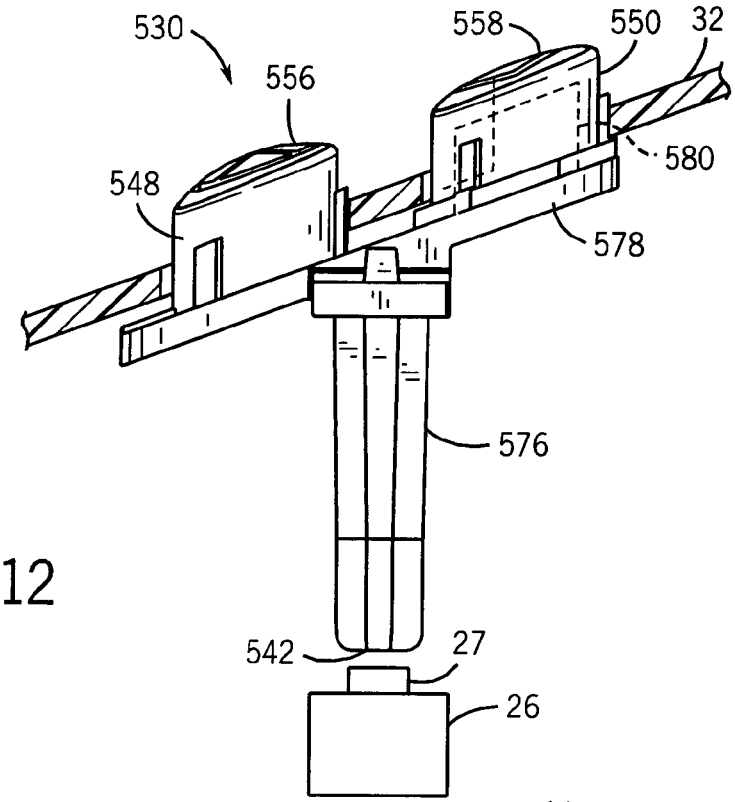
FIG. 12
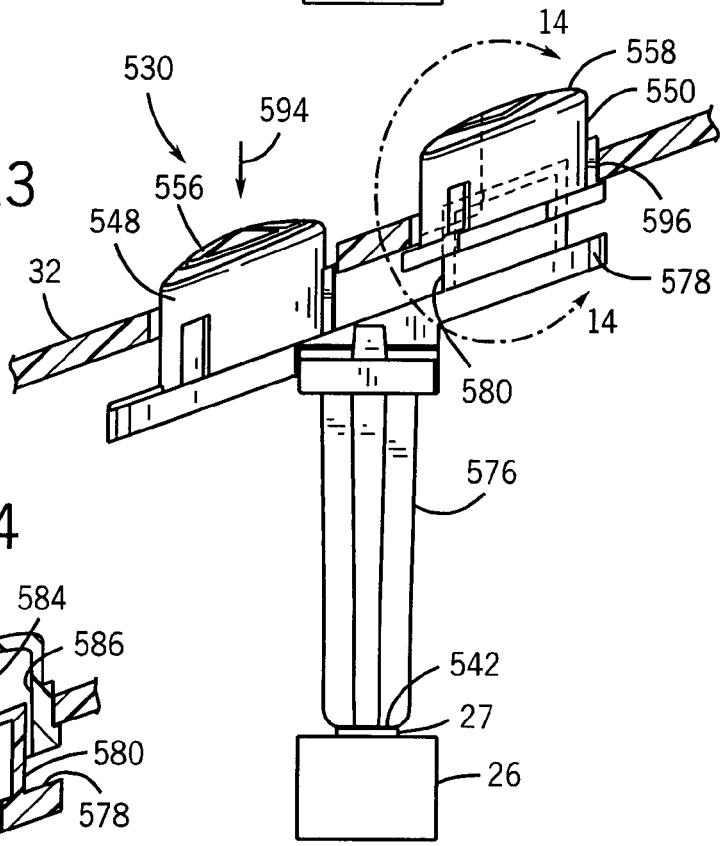
FIG. 13
FIG. 14
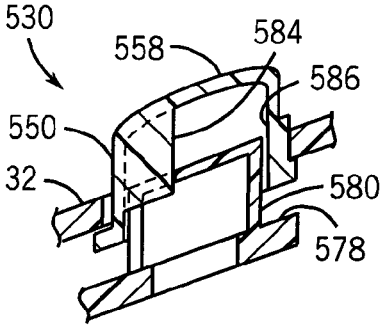

DEVICE SWITCH ACTUATION

BACKGROUND

Many of today's electronic devices, such as printers, scanners, computing devices and cameras provide the user with a multitude of different features, functions and options. In many devices, such options are chosen by actuation of a single switch. Unfortunately, many users do not take the time or effort to read a user manual or instructions provided with the electronic device to become adequately familiar with all the options or how such options may be chosen. As a result, many of these features or options are not appreciated or utilized.

BRIEF DESCRIPTION OF THE DRAWINGS

FIG. 12 is a sectional view of the switch actuation mechanism of FIG. 10 taken along line 12-12, according to an example embodiment.

FIG. 13 illustrates the switch actuation mechanism of FIG. 12 actuating switch 26, according to an example embodiment.

FIG. 14 is a sectional view of the switch actuation mechanism of FIG. 13 taken along line 14-14, according to an example embodiment.

DETAILED DESCRIPTION OF THE EXAMPLE EMBODIMENTS

Figure 1:
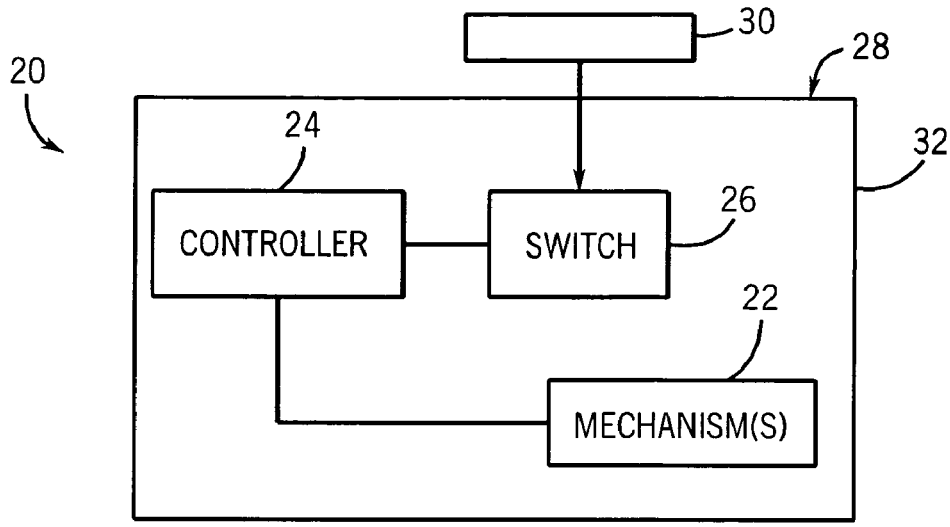
FIG. 1 is a schematic illustration of an example of an electronic device including a switch actuation mechanism.

FIG. 1 schematically illustrates electronic device 20 configured to perform one or more functions. Electronic device 20 generally includes mechanism 22, controller 24, switch 26, housing 28 and switch actuation mechanism 30. Mechanism 22 comprises one or more mechanism(s) configured to perform one or more functions of device 20. For example, in one embodiment, electronic device 20 may comprise an image forming device wherein mechanism(s) 22 comprises an imaging forming engine configured to print or otherwise form an image upon a medium such as paper. In particular image forming engines may include electrophotographic components such as a photoconductor drum or ink jet printing components such as an inkjet printhead. Mechanism(s) 22 generally performs such functions in response to control signals from controller 24.

Controller 24 generally comprises a processor unit configured to generate control signals. For purposes of this disclosure, the term "processor unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 24 is not limited to any specific combination of hardware circuitry and software, nor to any particular source for the instructions executed by the processing unit. In the particular embodiment illustrated, controller 24 generates such control signals based at least in part upon signals from switch 26.

Switch 26 generally comprises a switching device configured such that successive actuations of switch 26 actuates device 20 between a first state and a second state. In the particular embodiment illustrated, switch 26 is configured such that successive actuations of switch 26 through manual input causes switch 26 to generate first and second signals which are transmitted to controller 24, wherein controller 24 generates control signals that actuate mechanism(s) 22 between a first state and a second state. In one embodiment, switch 26 and controller 24 may alternatively be integrated into a single component. In yet another embodiment, electronic device 20 may omit controller 24, wherein successive actuations of switch 26 result in switch 26 transmitting first and second signals directly to mechanism(s) 22 so as to actuate mechanism(s) 22 between a first state and a second state.

Housing 28 generally comprises a frame, skin or enclosure extending at least partially about mechanism(s) 22, controller 24 and switch 26. Housing 28 includes an exterior top face 32 that is generally accessible by individuals using electronic device 20 for manual input to electronic device 20. Input to switch 26 by switch actuation mechanism 30 occurs along face 32.

Switch actuation mechanism 30 extends along top face 32 and is configured to actuate switch 26 a first time in response to a first input along face 32 and a second time in response to a second input along face 32. In alternative embodiments, mechanism 30 may be located along a side face of housing 28. In the particular embodiment, switch 26 is also actuated the second time in response to a third input identical to the first input but for the time at which it is performed. The first input and the second input both occur along a substantially planar region of face 32. For purposes of this disclosure the term "substantially planar" encompasses surfaces that may be slightly concave or slightly convex. As a result, such inputs or interactions with mechanism 30 may be easily identified and performed by an individual and the layout of input surfaces may be more compact and ergonomic. In the particular embodiment, the two inputs are parallel to one another. For example, such inputs may comprise pressing two buttons along parallel axes or sliding a member in two directions along a single axis.

In addition, the first input and the second input have at least one characteristic, other than the time at which they are performed, distinct from one another. Examples of such inputs having distinct characteristics include depression of two distinct buttons to provide distinct inputs or sliding a member into distinct directions to provide distinct inputs as described above. Even though the successive actuations of switch 26 which achieve different states of device 20 are substantially identical, switch actuation mechanism 30 enables two distinct inputs to achieve such actuations. As a result, switch actuation mechanism 30 enables a user of device 20 to associate distinct inputs with distinct states of electronic device 20. In addition, because the distinct inputs allowed by switch actuation mechanism 30 may be visually or otherwise communicated to the user of device 20, the user is immediately educated and immediately acquainted with the distinct state of electronic device 20 upon simply viewing the distinct inputs identified along face 32 without having to read a user's manual or instructions for such appreciation.

Figure 2:
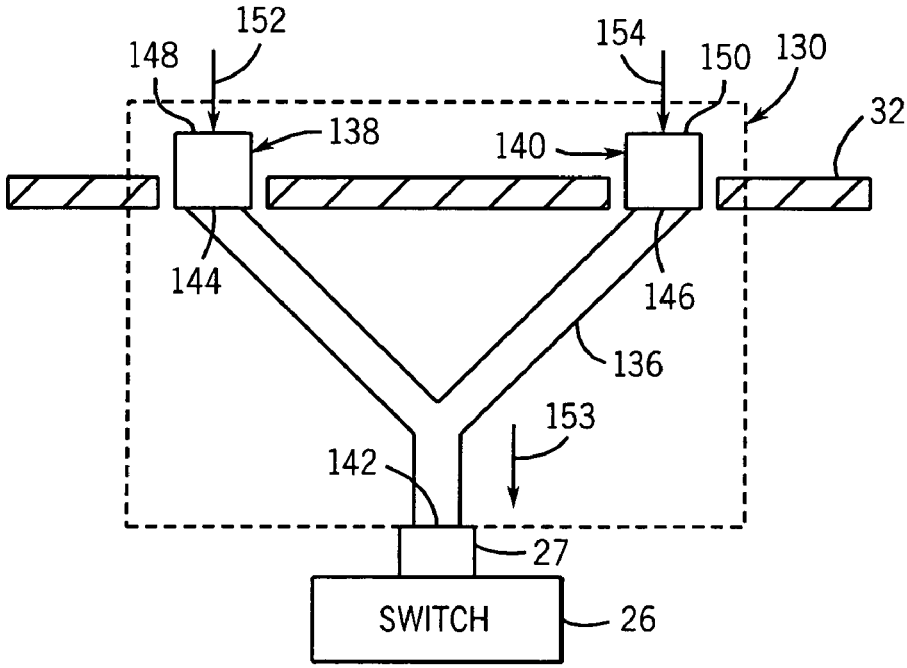
FIG. 2 is a sectional view schematically illustrating a specific embodiment of the switch actuation mechanism of FIG. 1.
Figure 3:
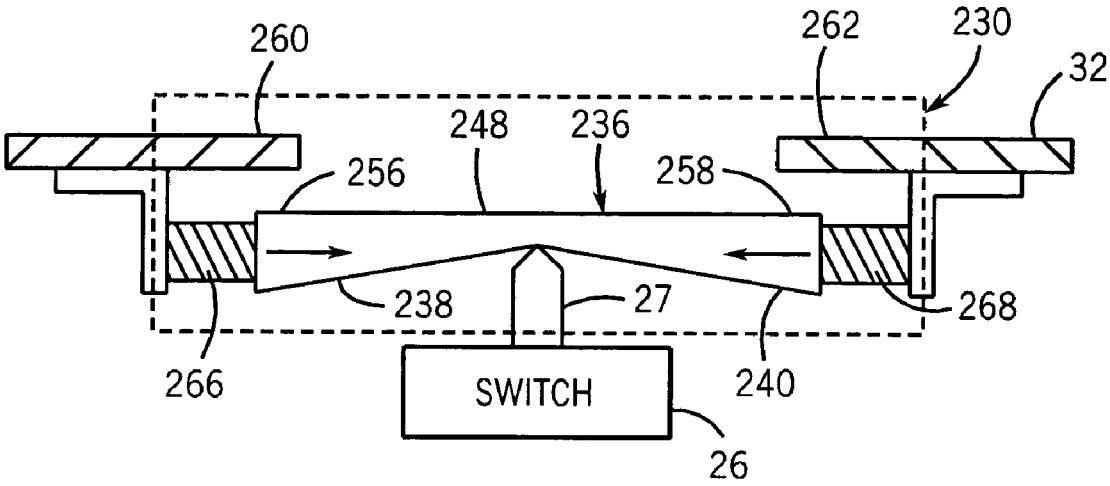
FIG. 3 is a sectional view schematically illustrating a second embodiment of the switch actuation mechanism of FIG. 1.
Figure 4:
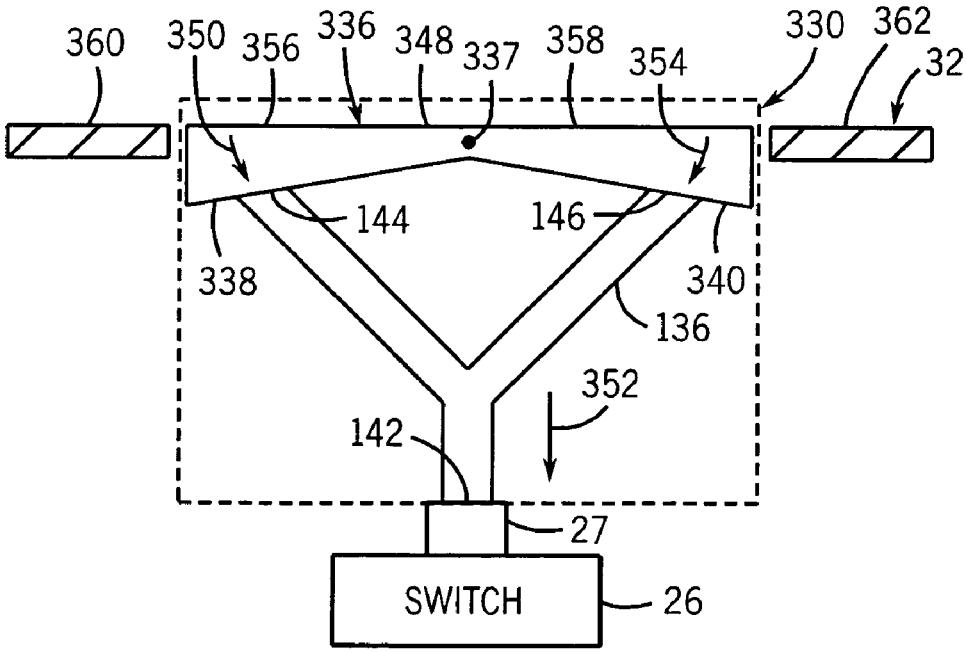
FIG. 4 is a sectional view of a third embodiment of the switch actuation mechanism of FIG. 1.

FIGS. 2-4 schematically illustrate three embodiments of switch actuation mechanism 30 shown and described with respect to FIG. 1. FIG. 2 illustrates switch actuation mechanism 130 for successively actuating switch 26 upon receiving input along face 32. In the embodiment shown in FIG. 2, switch 26 includes a resilient depressible actuator 27, which upon being successively depressed creates first and second signals. In alternative embodiments, switch 26 may have other actuation transducers.

Switch actuation mechanism 130 generally includes extension 136, push button 138 and push button 140. Extension 136 comprises one or more members which serve as a mechanical interface between both of push buttons 138, 140 and switch 26. Extension 136 is movably supported below face 32 and has switch engaging surface 142 and push button engagement surfaces 144 and 146. Switch engaging surface 142 is configured to abut actuator 27. Engagement surfaces 144 and 146 are configured to be engaged by push buttons 138 and 140, which are shown as extending through apertures formed in the face 32.

Push buttons 138 and 140 generally comprise members having movable surfaces 148 and 150, respectively. Push buttons 138 and 140 are movably supported relative to face 32 and may have distinct indicia enabling a user of device 20 to distinguish between push buttons 138 and 140 and to associate distinct functions or states of device 20 with push buttons 138 and 140. The indicia associated with push buttons 138 and 140 have distinct characteristics such as distinct color, distinct shape, distinct size, distinct texture, distinct markings, distinct alphanumeric symbols or distinct hardnesses. These indicia may be on the surfaces 148, 150 or on the face 32, for example. Depression of push button 138 in the direction indicated by arrow 152 results in push button 138 engaging surface 144 which moves surface 142 against actuator 27 of switch 26 to actuate switch 26. Similarly, depression of push button 140 in the direction indicated by arrow 154 causes push button 140 to engage surface 146 which results in surface 142 moving in the direction indicated by arrow 153 to depress actuator 27 of switch 26 to successively actuate switch 26.

Although switch actuation mechanism 130 is illustrated as having push buttons 138 and 140 which are distinct from extension 136, one or more of push buttons 138, 140 may alternatively be integrally formed as part of a single unitary body with extension 136. In particular embodiments, extension 136 may also be integrally formed as part of a single unitary body with actuator 27 of switch 26. Although in the embodiment illustrated, actuator 27 of switch 26 generally supports extension 136 such that extension 136 resiliently returns push buttons 138 and 140 to their initial positions after being depressed, switch actuation mechanism 130 may alternatively or additionally include one or more springs for resiliently biasing extension 136 and/or push buttons 138 and 140 towards an undepressed or raised position.

FIG. 3 schematically illustrates switch actuation mechanism 230, a second embodiment of switch actuation mechanism 30. Switch actuation mechanism 230 generally includes sliding member 236. Sliding member 236 is movably supported along face 32 for movement in a direction generally parallel to face 32. Member 236 includes sloped surfaces 238, 240 and contact surface 248. Sloped surfaces 238 and 240 extend along opposite portions of member 236 and are configured to engage actuator 27 of switch 26 so as to actuate switch 26 upon movement of member 236 in opposite directions. Contact surface 248 is exposed along face 32 and is configured to be contacted by a user's fingers to facilitate sliding movement of member 236.

In one embodiment, opposite portions of contact surface 248 are provided with distinct indicia associated with distinct functions or states that may be achieved by sliding member 236 in opposite directions along face 32. The distinct indicia have distinct characteristics such as distinct colors, distinct shapes, distinct sizes, distinct textures, distinct markings, distinct alphanumeric symbols or distinct hardnesses. For example, in one embodiment, portion 256 of surface 248 may be provided with a red color while portion 258 of surface 248 may be provided with a green color. The specific color or indicia may, of course, vary. When portion 256 is exposed along face 32, the function or functions being performed by mechanism 22 are paused or stopped. When portion 258 is exposed along face 32, the function or functions provided by mechanism(s) 22 are being performed. In alternative embodiments, portions of face 32 adjacent to opposite portions of member 236 may have distinct indicia associated with the distinct functions or states of electronic device 20 that may be achieved by moving member 236 in opposite directions. For example, in one embodiment, portion 260 of face 32 may be provided with a green color while portion 262 of face 32 is provided with red color to indicate that movement of member 236 towards portion 260 causes mechanism(s) 22 to perform its function or functions while movement of member 236 towards portion 262 cause such function or functions to be terminated or paused.

In the particular embodiment illustrated, switch actuation mechanism 230 additionally includes biasing members 266 and 268 which resiliently bias member 236 towards a neutral position. Biasing members 266 and 268 may comprise springs, resilient materials such as foam or other resilient members or materials. In alternative embodiments, members 266 and 268 may be omitted.

FIG. 4 schematically illustrates switch actuation mechanism 330, a third embodiment of switch actuation mechanism 30. Switch actuation mechanism 330 includes extension 136 and pivoting member 336. Extension 136 is described above with respect to FIG. 2. Pivoting member 336 generally comprises a member movably supported for pivotal movement about axis 337 and includes actuation surface 338, actuation surface 340 and contact surface 348. Actuation surface 338 is configured such that pivotal movement of member 336 about axis 337 in the direction indicated by arrow 350, results in actuation surface 338 engaging surface 144 to move extension 136 in the direction indicated by arrow 352 such that surface 142 depresses actuator 27 to actuate switch 26. Surface 340 is configured such that pivotal movement of member 336 about axis 337 in the direction indicated by arrow 354 causes surface 340 engage surface 146 and causes surface 142 to depress actuator 27 of switch 26 to actuate switch 26. For example, a pivot pin, hinge, or other suitable structure may provide for the pivotal movement of the member 336 about axis 337. Once switch 26 is actuated, switch 26 resiliently returns actuator 27 and member 336 to the neutral position, according to some embodiments.

Contact surface 348 is exposed along face 32 and is configured to be contacted by a user's fingers for actuation of switch 26. Contact surface 348 includes portions 356 and 358 on opposite sides of axis 337. Portions 356 and 358 include distinct indicia associated with distinct states and functions of device 20 that may be achieved by successive actuation of switch 26. The distinct indicia have distinct characteristics such as distinct color, distinct shape, distinct size, distinct texture, distinct markings, distinct alphanumeric symbols or distinct hardnesses. For example, in one embodiment, portion 356 may have a surface marking or embossment indicating the performance of a function by mechanism(s) 22 while portion 358 has a marking or embossment indicating the termination or pausing of a function by mechanism(s) 22. In another embodiment, portion 356 has a hard surface texture while portion 358 has a soft or compressible surface texture. In another embodiment, surface portion 356 may be provided with a green color while surface portion 358 is provided with a red color. In still other embodiments, face 32 is provided with distinct portions 360, 362 adjacent to opposite portions of member 336, wherein portions 360 and 362 have distinct indicia associated with distinct functions or distinct states of device 20.

Figure 5:
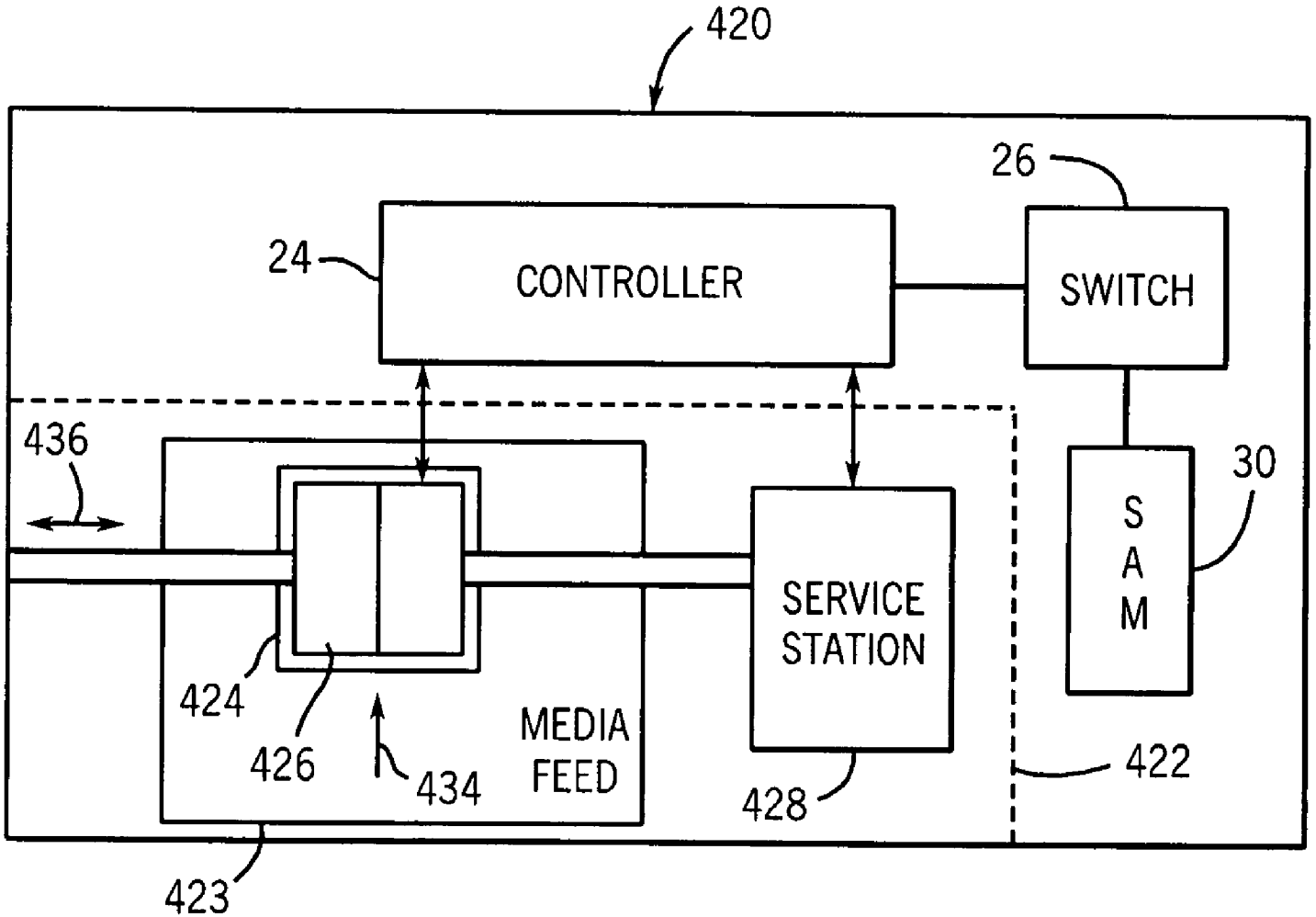
FIG. 5 is a schematic illustration of an example printing system including the switch actuation mechanism of FIG. 1.

FIG. 5 schematically illustrates printing system 420, a specific embodiment of device 20, shown and described with respect to FIG. 1. Printing system 420 is identical to electronic device 20 except that printing system 420 includes mechanism 422, a specific embodiment of mechanism(s) 22, configured to print an image upon a medium. Mechanism 422 generally includes media feeder 423, carriage 424, pens 426 and service station 428. Media feeder 423 comprises a drive configured to move a medium, such as paper, relative to pens 426. Pens 426, also referred to as print cartridges, dispense ink upon the medium to create images. Carriage 424 comprises a mechanism configured to move pens 426 relative to the medium being supplied and moved by feeder 422. In the particular embodiment illustrated, media feeder 423 moves paper in the direction indicated by arrow 434 while carriage 424 moves pens 426 in the directions indicated by arrows 436. Service station 428 comprises a conventionally known or future developed printer station including devices configured to perform servicing operations upon pens 426 between printing operations. Examples of such service operations include wiping and capping.

In alternative embodiments, mechanism 422 may comprise an electrophotographic imaging forming system wherein mechanism 422 includes a photoconductive drum in lieu of carriage 424, pens 426, and service station 428, wherein the drum dispenses an imaging material such as toner in lieu of ink imaging material.

Figure 6:
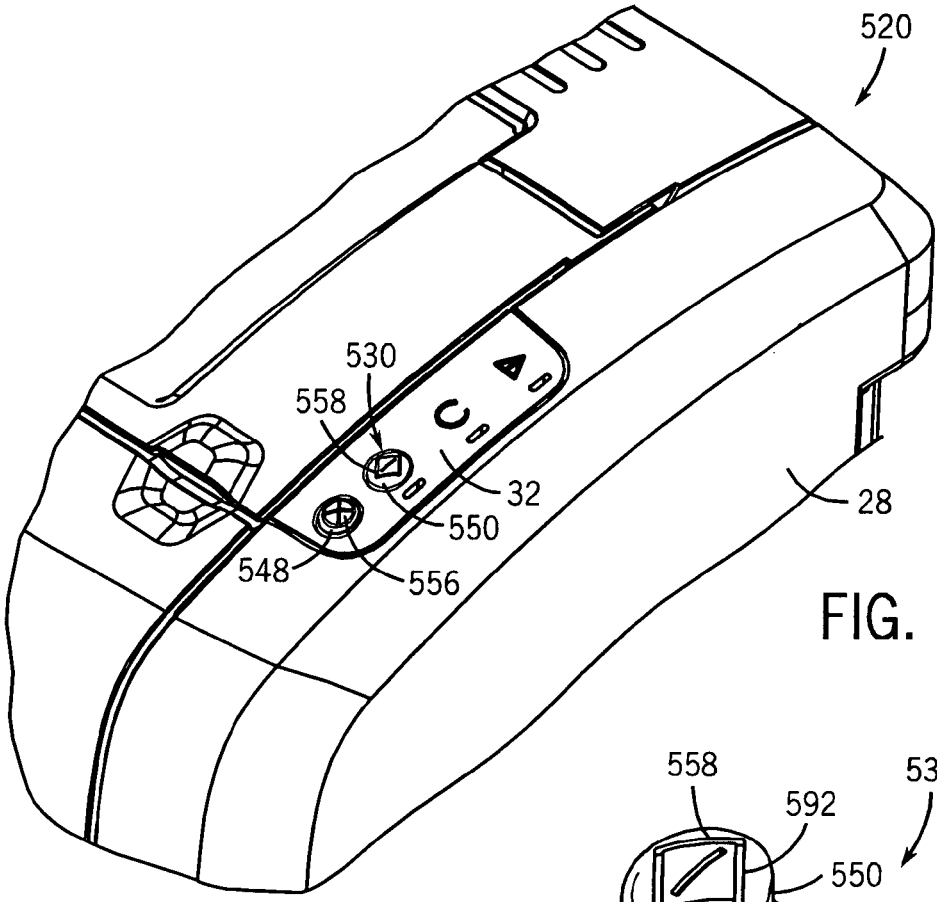
FIG. 6 is a fragmentary top perspective view of an embodiment of the printing system of FIG. 5 including an embodiment of the switch actuation mechanism of FIG. 2.
Figure 7:
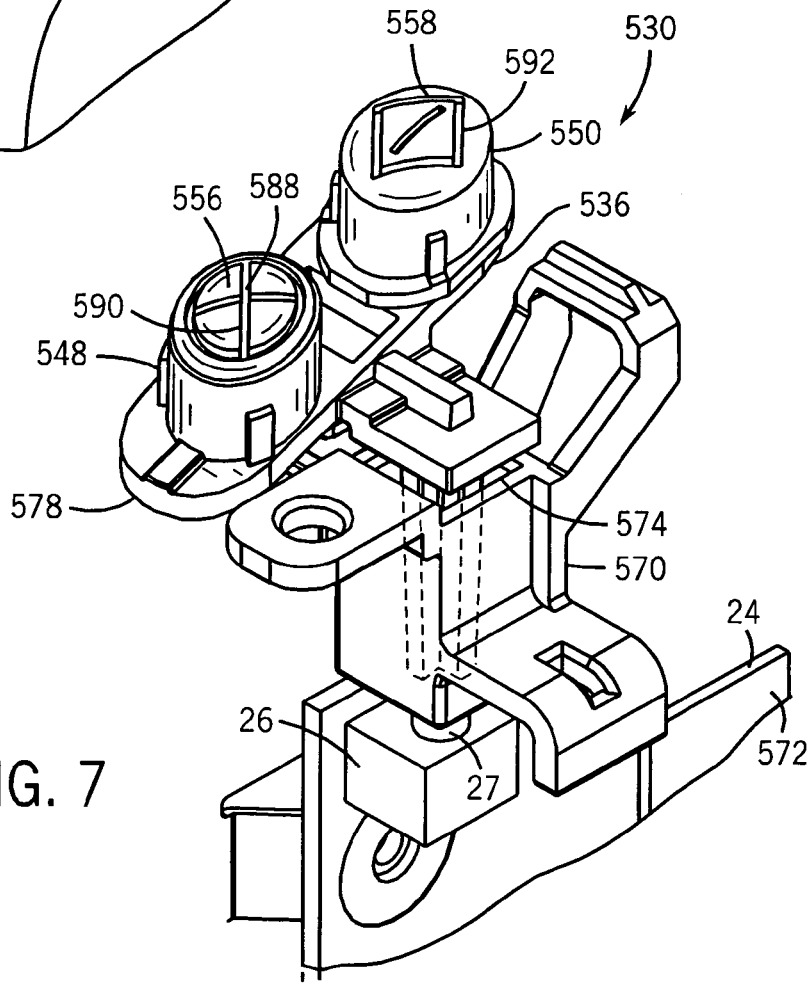
FIG. 7 is a fragmentary top perspective view of the switch actuation mechanism of FIG. 6 illustrating a switch and a controller, according to an example embodiment.

FIGS. 6-14 illustrate printing system 520, a specific embodiment of printing system 420 described with respect to FIG. 5. Printing system 520 is substantially identical to printing system 420 except that printing system 520 includes specific switch actuation mechanism 530, a specific embodiment of switch actuation mechanism 130 described with respect to FIG. 2. Switch actuation mechanism 530 generally includes guide 570, extension 536 and push buttons 548, 550. Guide 570 generally comprises a structure configured to guide movement of extension 536 relative to actuator 27 of switch 26. As shown by FIG. 7, switch 26 is coupled to controller 24 which includes a printed circuit board 572 along which signals are transmitted to various control components mounted or connected to circuit board 572. Guide 570 is coupled to housing 28 and includes an internal passageway 574 through which extension 536 extends into engagement with actuator 27 of switch 26. In alternative embodiments, guide 570 may be omitted where other structures are provided for guiding transmission of forces from push buttons 548 and 550 to actuator 27.

Figure 8:
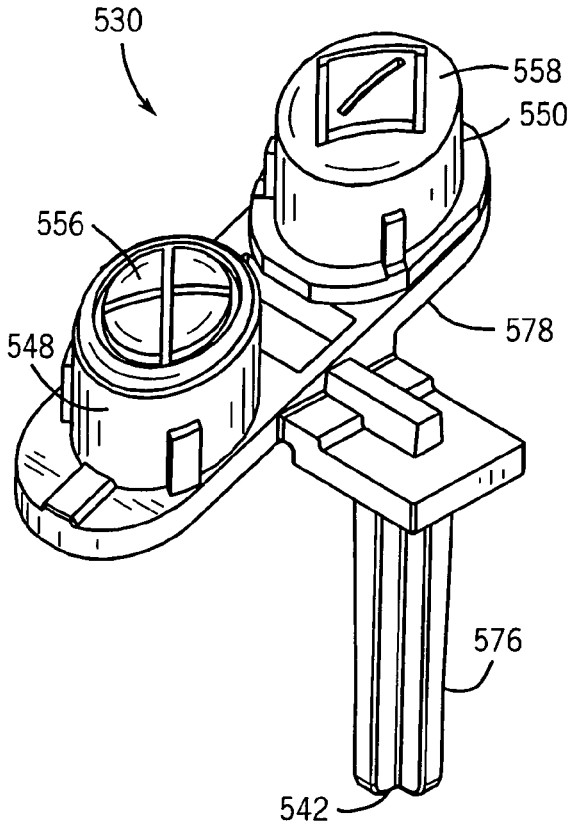
FIG. 8 is a top perspective view of the switch actuation mechanism of FIG. 7 according to an example embodiment.
Figure 9:
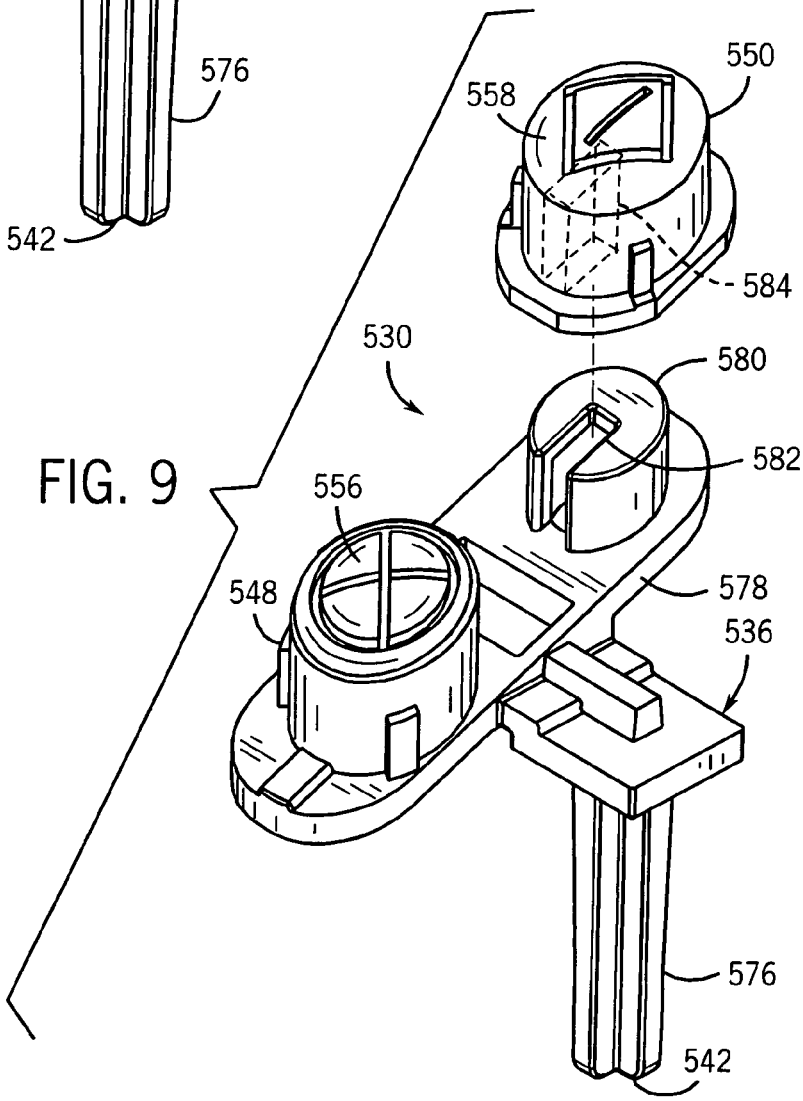
FIG. 9 is an exploded perspective view of the switch actuation mechanism of FIG. 8, according to an example embodiment.

As shown by FIGS. 8 and 9, extension 536 includes post 576 and platform 578. Post 576 extends from platform 578 and includes actuation surface 542 for engaging actuator 27 of switch 26. Platform 578 is coupled to post 576 and supports buttons 548 and 550 at least partially above face 32 (shown in FIG. 6) of housing 28. In the embodiment illustrated, platform 578 is integrally formed as part of a single unitary body with button 548 and is movable relative to button 550. Platform 578 includes boss 580. Boss 580 comprises a projection configured to be received within push button 550 to guide the relative movement of push button 550 and extension 536. In the particular embodiment illustrated, boss 580 additionally includes a channel 582 which is keyed to a corresponding projection 584 within an interior of push button 550.

Push buttons 548 and 550 are coupled to platform 578 of extension 536. Push button 548 is integrally formed as part of a single unitary body with platform 578. Alternatively, push button 548 may be permanently fastened or removably coupled to platform 578. As discussed above, push button 550 is movably coupled to platform 578. As shown by FIG. 14, push button 550 has an internal cavity 586 which slidably receives boss 580 with projection 584 received within channel 582 (shown in FIG. 9). As a result, push button 548 and extension 536 may be depressed relative to face 32 while push button 550 remains relatively stationary relative to face 32 (shown in FIG. 6). Because the depressment of push button 548 does not result in movement of push button 550 along face 32, switch actuation mechanism 536 better enables a user of printing system 520 to visually distinguish the distinct and separate inputs required to successfully actuate switch 26.

Figure 10:
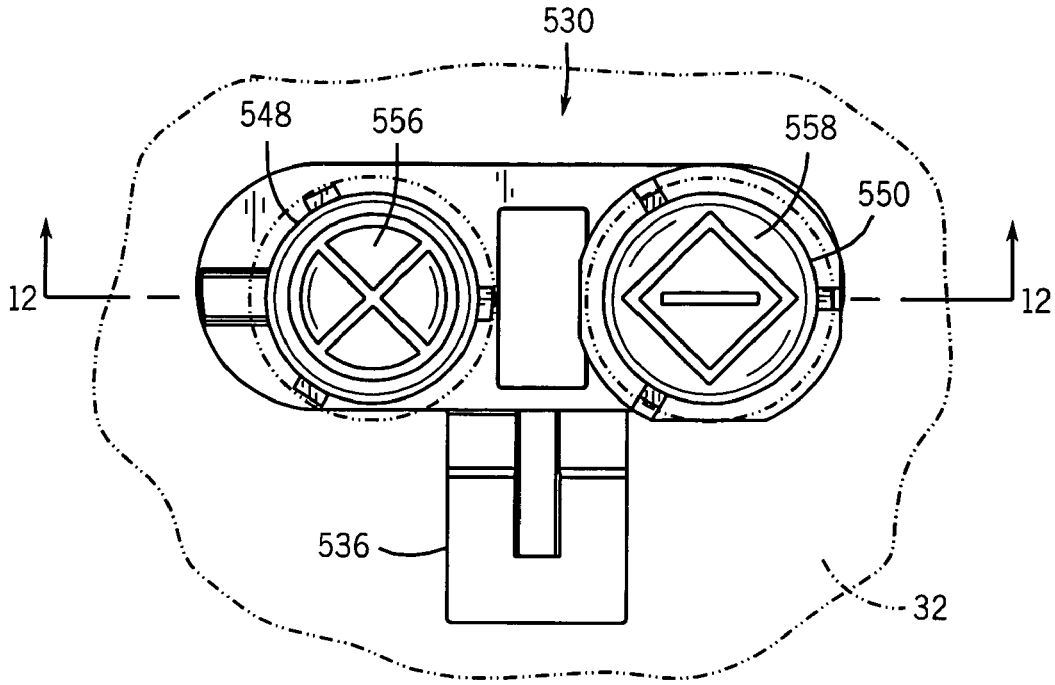
FIG. 10 is a top plan view of the switch actuation mechanism of FIG. 6, according to an example embodiment.
Figure 11:
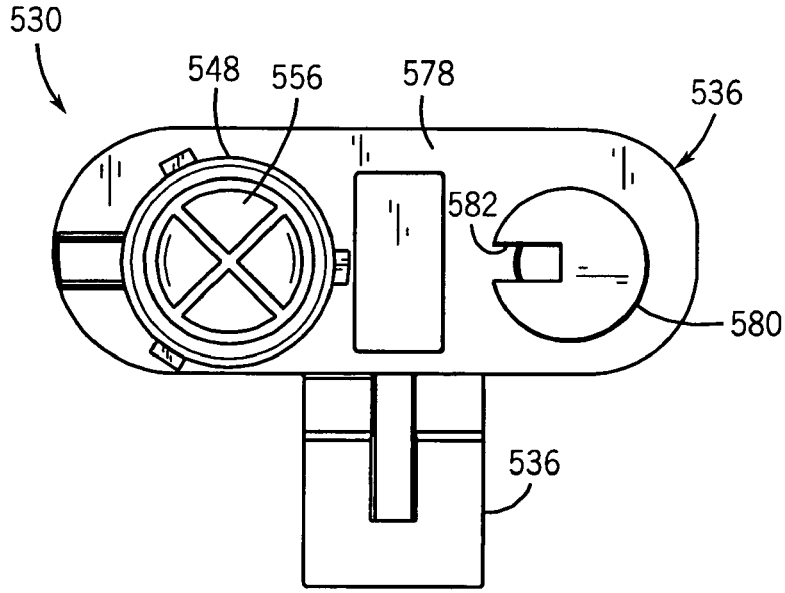
FIG. 11 is a top plan view of the switch actuation mechanism of FIG. 10 with a push button removed, according to an example embodiment.

As shown by FIG. 10, push buttons 548 and 550 include contact surfaces 556, 558, respectively. Surfaces 556 and 558 extend along face 32 (as shown in FIG. 6) and have distinct indicia which distinguish between distinct inputs required to successfully actuate switch 26. In the particular embodiment shown, contact surface 556 has a distinct shape, a distinct texture, a distinct surface marking and a distinct color as compared to contact surface 558. Contact surface 556 has a circular channel 588. Contact surface 558 omits such a channel. Contact surface 556 has an X-shaped surface marking 590. Contact surface 558 has a diamond and internal bar marking 592. Contact surface 556 is provided with a red color while contact surface 558 is provided with a green color. In alternative embodiments, contact surfaces 556 and 558 may have fewer or greater distinct indicia. In alternative embodiments, contact surfaces 556 and 558 may be identical to one another while portions of face 32 adjacent to contact surfaces 556 and 558 have distinct indicia.

FIGS. 13 and 14 illustrate the general operation of switch actuation mechanism 530. FIG. 13 illustrates actuation mechanism 530 in a neutral position prior to actuation of switch 26. FIG. 13 illustrates switch 26 being actuated upon depression of push button 548 in the direction indicated by arrow 594. As a result, surface 542 of post 576 is forced downward to compress actuator 27 of switch 26 so as to actuate switch 26. In the embodiment illustrated, this results in printing mechanism 422 (shown in FIG. 5) being stopped or paused. As contact surface 556, which is red, is being depressed, contact surface 558 of push button 550 remains relatively stationary with respect to surface 32. In the embodiment shown, the relative friction between push button 550 and aperture 596, through which push button 550 projects above surface 32, retains push button 550 in place as extension 536 is being moved. In alternative embodiments, switch actuation mechanism 530 may additionally have a spring or other biasing mechanism between platform 578 and push button 550 to maintain push button 550 in place as extension 536 is being moved.

Depressment of push button 550 results in the lower surface of push button 550 contacting platform 578 and moving extension 536 towards switch 26. This results in surface 542 of post 576 actuating switch 26. In the embodiment shown, this successive actuation of switch 26 changes the state of printing mechanism 422 to a printing state in which printing is continued.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. An electronic device comprising:

a face;

a switch configured such that successive identical actuations of the switch actuate the device between a first state and a second state; and a switch actuation mechanism configured to actuate against a point of contact of the switch a first time in response to a first manual input along the face to actuate the device to the first state and to actuate against the same point of contact portion of the switch a second time in response to a second manual input along the face to actuate the device to the second state, wherein the second input has at least one characteristic, other than time at which it is performed, distinct from the first input.

2. The device of claim 1, wherein a function is performed when the device is in the first state and wherein the function is discontinued when the device is in the second state.

3. The device of claim 2, wherein the function is printing upon a print medium.

4. The device of claim 3, wherein the switch actuation mechanism includes a first movable surface and a second movable surface and wherein the first input includes moving the first movable surface and wherein the second input includes moving the second movable surface.

5. The device of claim 1, wherein the switch actuation mechanism includes a first movable surface and a second movable surface and wherein the first input includes moving the first movable surface and wherein the second input includes moving the second movable surface.

6. The device of claim 5, wherein the first movable surface is depressible.

7. The device of claim 6, wherein the second movable surface is depressible.

8. The device of claim 5, wherein the first surface and the second surface are spaced from one another along the face.

9. The device of claim 5, wherein the first movable surface has a first indicia and wherein the second movable surface has a second indicia distinct from the first indicia.

10. The device of claim 9, wherein the first indicia and the second indicia have distinct characteristics chosen from a group including color, shape, size, texture, markings, alphanumeric symbols and hardness.

11. The device of claim 10, wherein the first indicia includes a first color and wherein the second indicia includes a second color distinct from the first color.

12. The device of claim 11, wherein the first color is green and wherein the second color is red.

13. The device of claim 12, wherein the device performs a function upon movement of the first surface and discontinues the function upon movement of the second surface.

14. The device of claim 5, wherein the actuation mechanism includes:

a first button providing the first surface;

a second button providing the second surface; and an extension coupled to the first button and the second button and linearly movable relative to the switch.

15. The device of claim 14 including a guide guiding linear movement of the extension relative to the switch.

16. The device of claim 14, wherein the extension is linearly movable relative to the first button.

17. The device of claim 1, wherein the switch actuation mechanism includes an actuation member slidable along the face, wherein the first input includes sliding the actuation member in a first manner and wherein the second input includes sliding the actuation member in a second manner.

18. The device of claim 1, wherein the actuation mechanism includes an actuation member pivotally supported along the face, wherein the first input includes pivoting the actuation member in a first manner and wherein the second input includes pivoting the actuation member in a second manner.

19. The device of claim 1 including:

an imaging material dispensing device; and a controller coupled to the switch and configured to generate control signals upon actuation of the switch, wherein the dispensing device dispenses imaging material and discontinues dispensing imaging material in response to the control signals.

20. The device of claim 1, wherein the first input and the second input are parallel to one another.

21. The device of claim 1, wherein the switch actuation mechanism is configured to also actuate the switch the second time in response to a third input identical to the first input, other than the time at which it is performed and in lieu of the second input.

22. The electronic device of claim 1, wherein the switch includes a resilient depressible actuator, wherein a same portion of the actuator is depressed in response to both the first input and the second input.

23. An electronic device comprising:

a face;

a switch configured such that successive actuations of the switch that are identical other than time at which they are performed, actuate the device between a first state and a second state; and means along the face for actuating the switch a first time using a first manual input and a second time using a second manual input having at least one characteristic, other than time at which it is performed, distinct from the first manual input, wherein the means for actuating is configured to also actuate the switch the second time in response to a third input identical to the first input, other than the time at which it is performed and in lieu of the second input.

24. The device of claim 23, wherein the first input and the second input are parallel to one another.

25. A method for actuating an electronic device between a first state and a second state, the method comprising:

providing a switch configured such that successive actuations of the switch that are identical other than time at which they are performed, actuate the device between a first state and a second state;

applying a first manual input, along a substantially planar face of the device so as to actuate the switch a first time; and applying a second manual input along the substantially planar face of the device so as to actuate the switch a second time, wherein the second manual input has at least one characteristic, other than the time at which it is performed, that is distinct from the first manual input, wherein the step of applying a first input includes moving an actuation member in a first manner and wherein the step of applying a second input includes moving the actuation member in a second distinct manner.

26. The method of claim 25, wherein the step of applying a first input includes depressing a first actuation member operably coupled to the switch.

27. The method of claim 26, wherein the step of applying a second input includes depressing a second actuation member operably coupled to the switch.

28. The method of claim 25, wherein the first manner includes sliding the actuation member along the face in a first direction and wherein the second manner includes sliding the actuation member in a second direction along the face.

29. The method of claim 25, wherein the first manner includes pivoting the actuation member in a first direction and wherein the second manner includes pivoting the actuation member in a second direction.

30. The method of claim 25, wherein the first input and the second input are parallel to one another.

31. An image forming device comprising:

an image forming engine actuatable between a first state and a second state;

a switch configured such that successive actuations of the switch actuate the engine between the first state and the second state;

a post operably coupled to the switch to apply an actuating force to the switch;

a first movable input surface configured to successively actuate the switch; and a second movable input surface configured to successively actuate the switch, wherein the first movable input surface and the second movable input surface are both coupled to the post such that movement of the first movable input surface linearly moves the post along an axis against the switch to actuate the engine to the first state and movement of the second movable input surface linearly moves the post along the axis against the switch to actuate the engine to the second state, wherein the first movable input surface and the second movable input surface pivot to successively actuate the switch.

32. The image forming device of claim 31 wherein the first movable input surface and the second movable input surface are located on a substantially planar region of an exterior of the device.

33. The image forming device of claim 31 wherein the first movable input surface and the second movable input surface are configured to be depressed to successively actuate the switch.

34. The image forming device of claim 31 including a first button providing the first movable input surface and a second button providing the second movable input surface.

35. The image forming device of claim 31 wherein the first movable input surface and the second movable input surface have distinct associated indicia.

36. An electronic device comprising:

a face;

a switch configured such that successive actuations of the switch actuate the device between a first state and a second state; and a switch actuation mechanism configured to actuate against a portion of the switch a first time in response to a first manual input along the face and to actuate against the same portion of the switch a second time in response to a second manual input along the face, wherein the second input has at least one characteristic, other than time at which it is performed, distinct from the first input, wherein the switch actuation mechanism includes an actuation member slidable along the face, wherein the first input includes sliding the actuation member in a first manner and wherein the second input includes sliding the actuation member in a second manner.

* * * * *